US007726634B2

(12) United States Patent
Neal et al.

(10) Patent No.: US 7,726,634 B2
(45) Date of Patent: Jun. 1, 2010

(54) SYSTEM AND METHOD FOR TENSIONING AND LOCKING A SAFETY STRAND

(75) Inventors: Roy E. Neal, Hampton, VA (US); Lowell W. Cramer, Carrollton, VA (US); Clifton Lathan, Jr., Suffolk, VA (US); Herman Carter, Newport News, VA (US); Myron Evans, Virginia Beach, VA (US)

(73) Assignee: Newport News Shipbuilding and Dry Dock Company, Newport News, VA (US)

( * ) Notice: Subject to any disclaimer, the term of this patent is extended or adjusted under 35 U.S.C. 154(b) by 461 days.

(21) Appl. No.: 11/567,811

(22) Filed: Dec. 7, 2006

(65) Prior Publication Data

US 2008/0134656 A1 Jun. 12, 2008

(51) Int. Cl.
*E04H 17/04* (2006.01)

(52) U.S. Cl. ..... 256/47; 24/277

(58) Field of Classification Search ..... 256/10, 256/37, 45–47, 54, 55; 24/277
See application file for complete search history.

(56) References Cited

U.S. PATENT DOCUMENTS

| | | | | | |
|---|---|---|---|---|---|
| 310,624 | A * | 1/1885 | Van Luven | 256/37 |
| 314,785 | A * | 3/1885 | Bissell | 256/35 |
| 355,135 | A * | 12/1886 | Bunch | 254/243 |
| 504,368 | A * | 9/1893 | Schalk et al. | 256/43 |
| 534,234 | A * | 2/1895 | Stowell et al. | 256/40 |
| 541,487 | A * | 6/1895 | Little | 256/45 |
| 709,617 | A * | 9/1902 | Utter | 256/55 |
| 1,501,665 | A * | 7/1924 | James | 256/55 |
| 1,824,368 | A * | 9/1931 | Ramsey et al. | 248/66 |
| 2,172,919 | A * | 9/1939 | Wertman | 256/13.1 |
| 2,410,228 | A * | 10/1946 | Lee | 256/13.1 |
| 2,906,551 | A * | 9/1959 | May | 403/218 |
| 4,771,137 | A * | 9/1988 | Thompson | 174/163 F |
| 4,883,923 | A * | 11/1989 | Langlie et al. | 174/158 F |
| 5,593,142 | A * | 1/1997 | Gerhart | 256/54 |
| 5,623,791 | A * | 4/1997 | Schwarz | 52/107 |
| 5,992,828 | A * | 11/1999 | Burdick | 256/10 |
| 6,178,603 | B1 * | 1/2001 | Lillig | 24/132 R |
| 6,227,757 | B1 * | 5/2001 | Delouvee et al. | 403/400 |
| 6,347,904 | B1 * | 2/2002 | Knighton | 403/400 |
| 6,866,252 | B2 * | 3/2005 | Pulliam | 256/40 |
| 6,874,767 | B1 * | 4/2005 | Gibbs | 256/65.08 |
| 6,948,703 | B2 * | 9/2005 | Alberson et al. | 256/13.1 |

(Continued)

*Primary Examiner*—Daniel P Stodola
*Assistant Examiner*—Joshua T Kennedy
(74) *Attorney, Agent, or Firm*—Alston & Bird LLP

(57) ABSTRACT

A system for tensioning and locking a safety strand to a number of sequentially arranged stanchions is provided. The system includes tensioning means for applying a tensile force to one end of the safety strand when the safety strand is passed through a passage bore of each of the sequentially arranged stanchions and the other end of the safety strand is secured to an immovable object. Locking mechanisms are provided that each include a cable cradle having a receiving channel for receiving a portion of the safety strand, a clamping arrangement for engaging and trapping the portion of the safety strand within the receiving channel, and a device for securing the cable cradle and clamping arrangement to a stanchion. The cable cradle and securing device are configured so that when the cable cradle is secured to the selected stanchion, the receiving channel is in registry with the passage bore.

13 Claims, 8 Drawing Sheets

U.S. PATENT DOCUMENTS 7,475,868 B1 * 1/2009 Gibbs ..... 256/23
2004/0149976 A1 * 8/2004 Russo ..... 256/47
2006/0145131 A1 * 7/2006 Purvis ..... 256/13.1

* cited by examiner

SYSTEM AND METHOD FOR TENSIONING AND LOCKING A SAFETY STRAND

BACKGROUND OF THE INVENTION

The present invention relates generally to the field of safety barriers and more particularly to a system for maintaining tension in safety wires.

It is common practice in the construction industry to build a temporary or movable platform for a construction worker to stand on, and for supporting tools and materials. The platform may be supported by the ground, or may be suspended from above, or may be attached to a nearby large object such as the side of a ship. The platform may also be known as scaffolding, or staging. The platform may be used for constructing ships or constructing buildings.

It is common practice to place a safety barrier along the outside of the platform, in order to prevent the construction worker from falling from the platform. Falling from the platform may severely injure or kill the construction worker. Similarly, safety barriers may be placed around the perimeter of a dangerous hole or dangerous machinery. The term platform is defined broadly, and includes any approximately horizontal working surface from which a worker may fall. For example, the deck of a ship may be a platform.

Specifically, one common practice in the industry is to rig a safety strand through posts spaced at regular intervals along one or more edges of the platform. These posts may also be known as safety uprights, poles, or stanchions. The posts may be formed from any rigid member such as steel or iron channel stock having a hollow rectangular cross section, angle iron stock with an "L" shaped cross section, or pipe. The posts may be integrated into a support bracket for the platform, and the support bracket may be bolted or welded to the side of a ship or other structure. Horizontal wood or aluminum decking may link the support brackets to create a horizontal working platform.

The posts are typically linked with a safety strand in the form of a steel cable, or other line to prevent the construction worker from accidentally falling from the exterior edges of the platform. The steel cable may be positioned at any height, but is typically positioned at about waist high (about four feet high) above the horizontal surface of the platform. Additional cables may be positioned at other heights for additional safety. For example a second cable may be positioned horizontally at about two feet high. At the end of the platform, the cables may be attached directly to the structure.

The safety strand is attached to the vertical posts by various fastening techniques. One conventional fastening technique involves threading the cable through a hole in the post, looping the cable around the post and then proceeding to the next post. This technique, which may be referred to as "round turn" technique may also include forming a simple overhand knot to secure the strand to the post.

One problem with the round turn technique is that it requires the strand to be relatively flexible. This may place limitations on the material or diameter of the strand. In some cases, the strand may be sufficiently flexible to form a knot, but the resulting attachment may be relatively loose. This, in turn, may limit the ability to maintain sufficient tension in the strand.

Another problem with the round turn approach is that, even if a high degree of tension can be established initially, it may be difficult to maintain this tension. Workers have a tendency to lean on safety strands or place materials against them, which places the strand under additional tension. Application and removal of such additional loads can cause the strands to slacken over time.

The present invention eliminates the "round turn" technique, and creates a stable and secure attachment of the cable to the post. This stable and secure attachment creates and maintains a tight cable with relatively high tension.

SUMMARY OF THE INVENTION

An illustrative aspect of the invention provides a system for tensioning and locking a safety strand to a plurality of sequentially arranged stanchions. Each stanchion has a stanchion cross section and a passage bore adapted for slidable passage of the safety strand therethrough. The system comprises tensioning means for applying a tensile force to a first end of the safety strand when the safety strand is disposed through the passage bore of each of the sequentially arranged stanchions and a second end of the safety strand is secured to an immovable object. The system further comprises a plurality of locking mechanisms. Each locking mechanism comprises a cable cradle having a receiving channel configured for receiving a portion of the safety strand, a clamping arrangement adapted for engaging and trapping the portion of the safety strand within the receiving channel, and means for securing the cable cradle and clamping arrangement to a selected one of the plurality of stanchions when the safety strand is disposed through the passage bore of the selected stanchion. The cable cradle and means for securing are configured so that when the cable cradle is secured to the selected stanchion, the receiving channel is in registry with the passage bore.

BRIEF DESCRIPTION OF THE DRAWINGS

The present invention can be more fully understood by reading the following detailed description together with the accompanying drawings, in which like reference indicators are used to designate like elements.

DETAILED DESCRIPTION OF THE INVENTION

Hereinafter, various embodiments of the invention will be described. As used herein, any term in the singular may be interpreted in the plural, and alternately, any term in the plural may be interpreted to be in the singular.

The present invention improves the safety of workers by enhancing the reliability of safety strands used to prevent workers and equipment from falling from work platforms or other structures. This is accomplished by reducing the potential for slack in such safety strands, thereby assuring that the safety strands are maintained at their intended position with their designed stability and loading capability.

Embodiments of the present invention provide a system and method for tensioning and securing a safety strand to the stanchions of a work platform or other structure. The basic methodology of the invention is to apply tension to the strand as it is sequentially routed through and secured to the stanchions. The strand may be secured to some or all of the stanchions using relatively simple hardware without major modification to existing stanchions. Tension may be applied to the strand using any suitable tensioning mechanism such as a winch.

As used herein, the term "strand" includes any form of filament or bundle of filaments that can support a tensile load. Strands that may be used in embodiments of the invention include any form of rope, wire or cable and may be formed from any suitable material.

Figure 3:
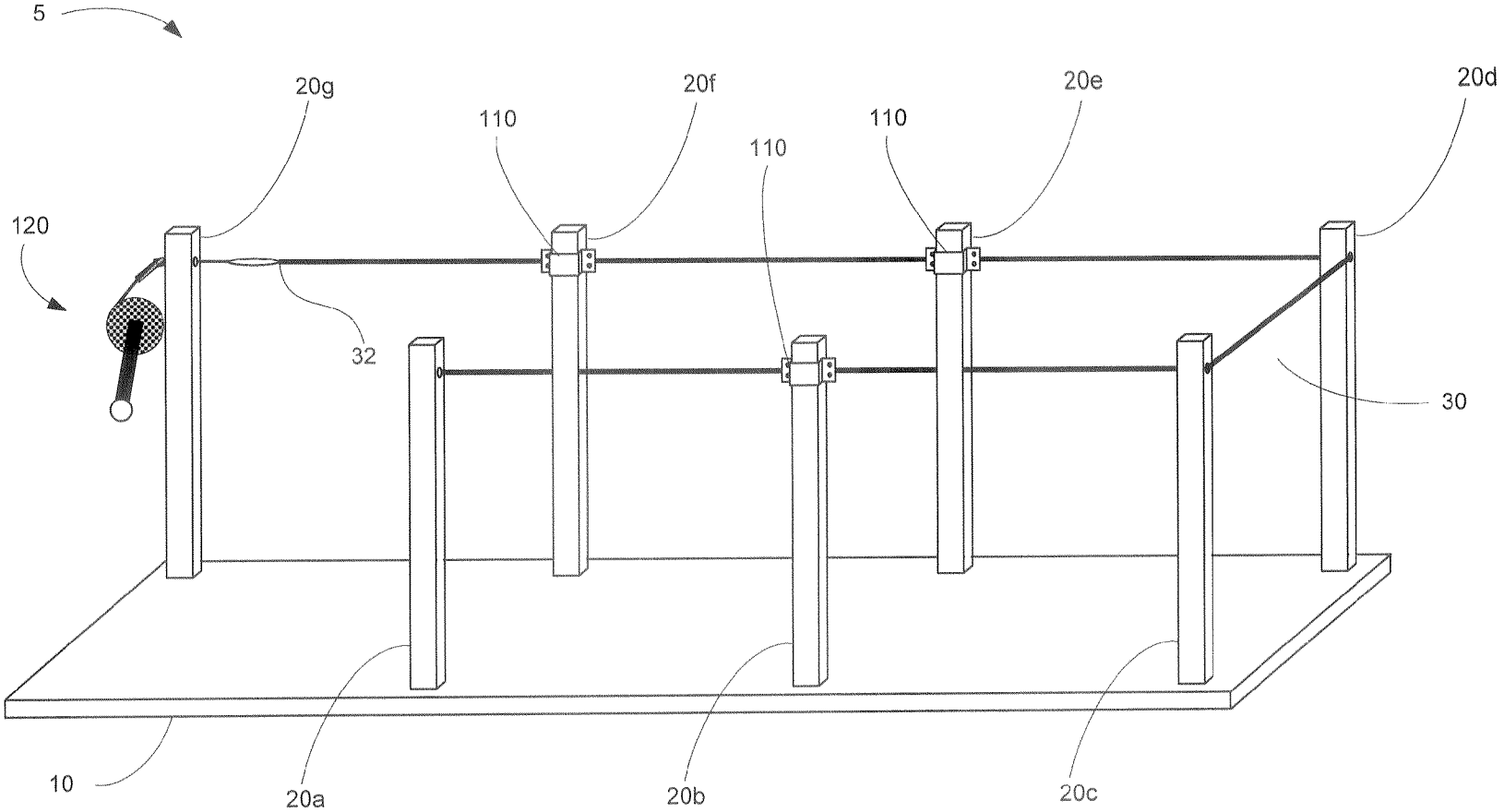
FIG. 3 is a schematic representation of the safety strand arrangement of FIG. 1 wherein the safety strand is in a tightened and locked condition.
Figure 4:
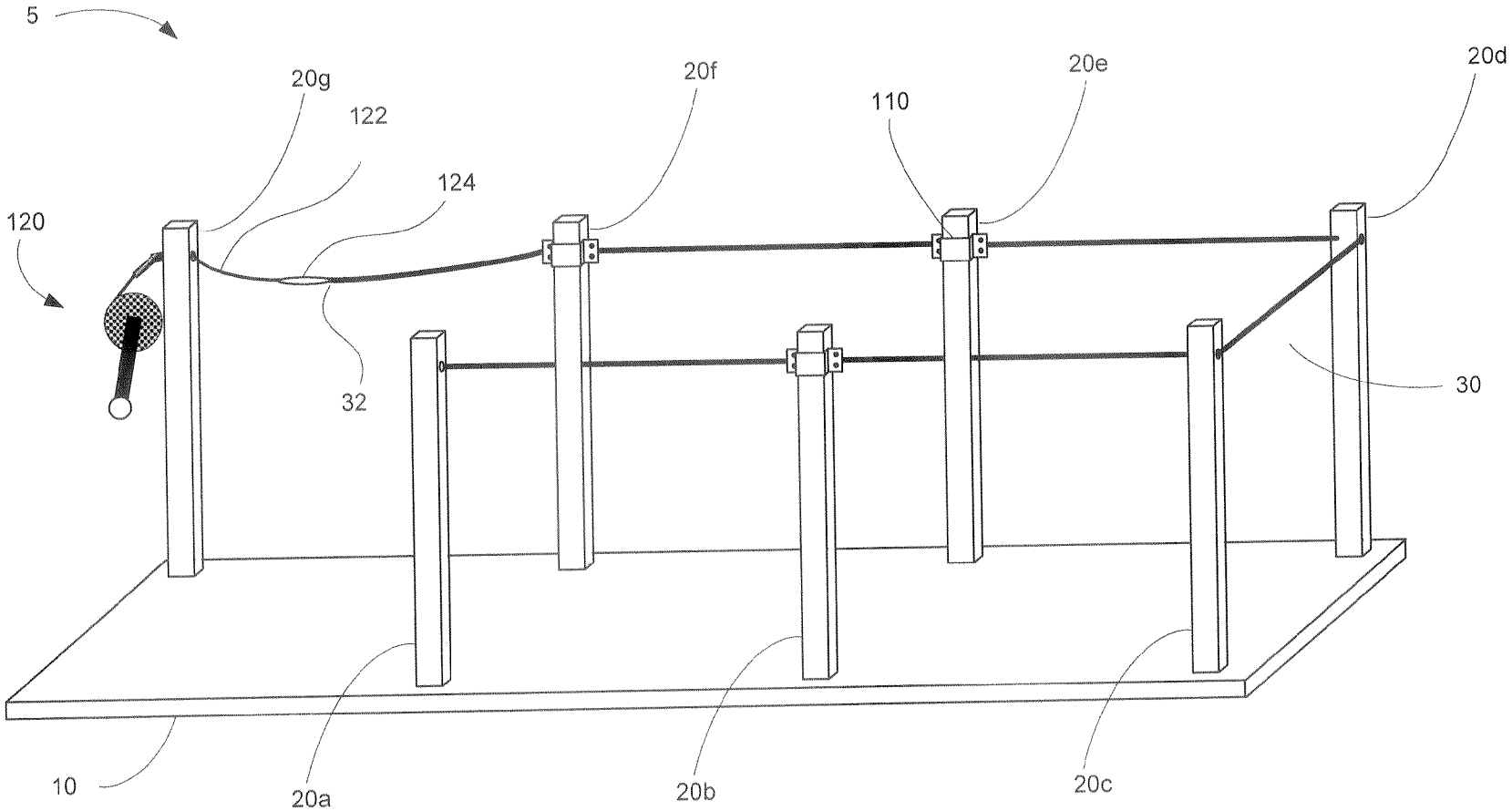
FIG. 4 is a schematic representation of the safety strand arrangement of FIG. 1 wherein the safety strand is in a tightened and locked condition.
Figure 5:
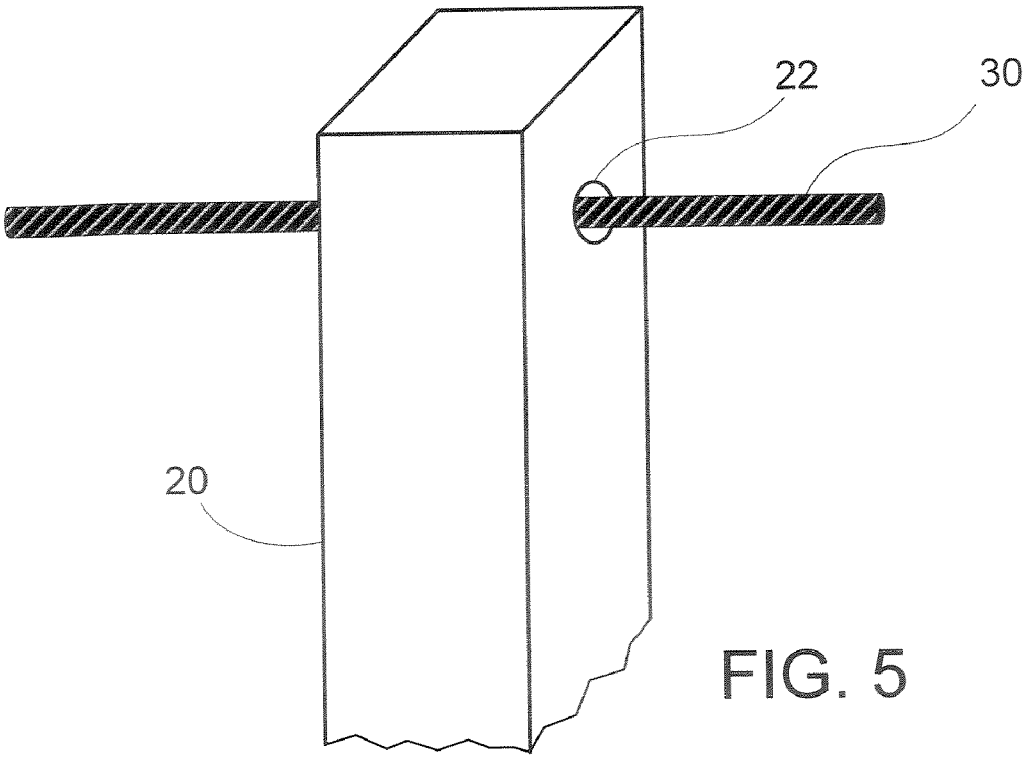
FIG. 5 is a perspective view a portion of a stanchion having a rectangular cross-section.
Figure 6:
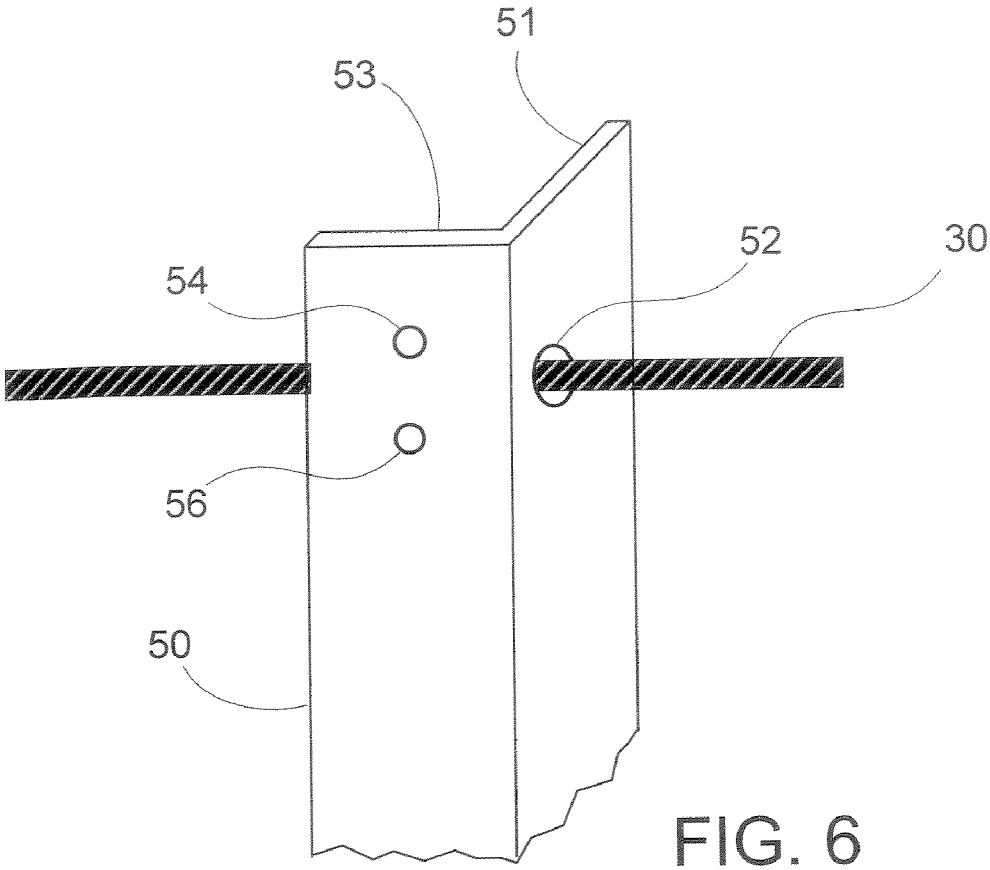
FIG. 6 is a perspective view a portion of a stanchion having an L-shaped cross-section.

FIGS. 1-4 illustrate a method of the invention as applied to a typical safety strand arrangement 5. In this arrangement 5, a safety strand 30 is set up for protection along a portion of the perimeter of a platform 10. The safety strand 30 is strung sequentially through a series of stanchions 20, which serve to support the safety strand at a desired height. Although the stanchions 20 shown in FIGS. 1-4 are posts having a rectangular cross-section, the method may be applied to L-shaped and other stanchion types as noted above. With reference to FIGS. 5 and 6, which illustrate a rectangular stanchion 20 and an L-shaped stanchion 50, respectively, each stanchion 20 (or 50) has a passage 22 (or 52) through which the safety strand 30 is passed.

In the illustrated arrangement, one end of the safety strand 30 is attached to the first stanchion 20*a*. This may be done before or after stringing the safety strand 30 through the other stanchions. Alternatively, the safety strand may be strung through the first stanchion 20*a* as well and the first end of the strand 30 attached to another fixed object. Notably, the method of the present invention can also be applied to a safety strand arrangement in which the safety strand is already in place as shown in FIG. 1.

Figure 1:
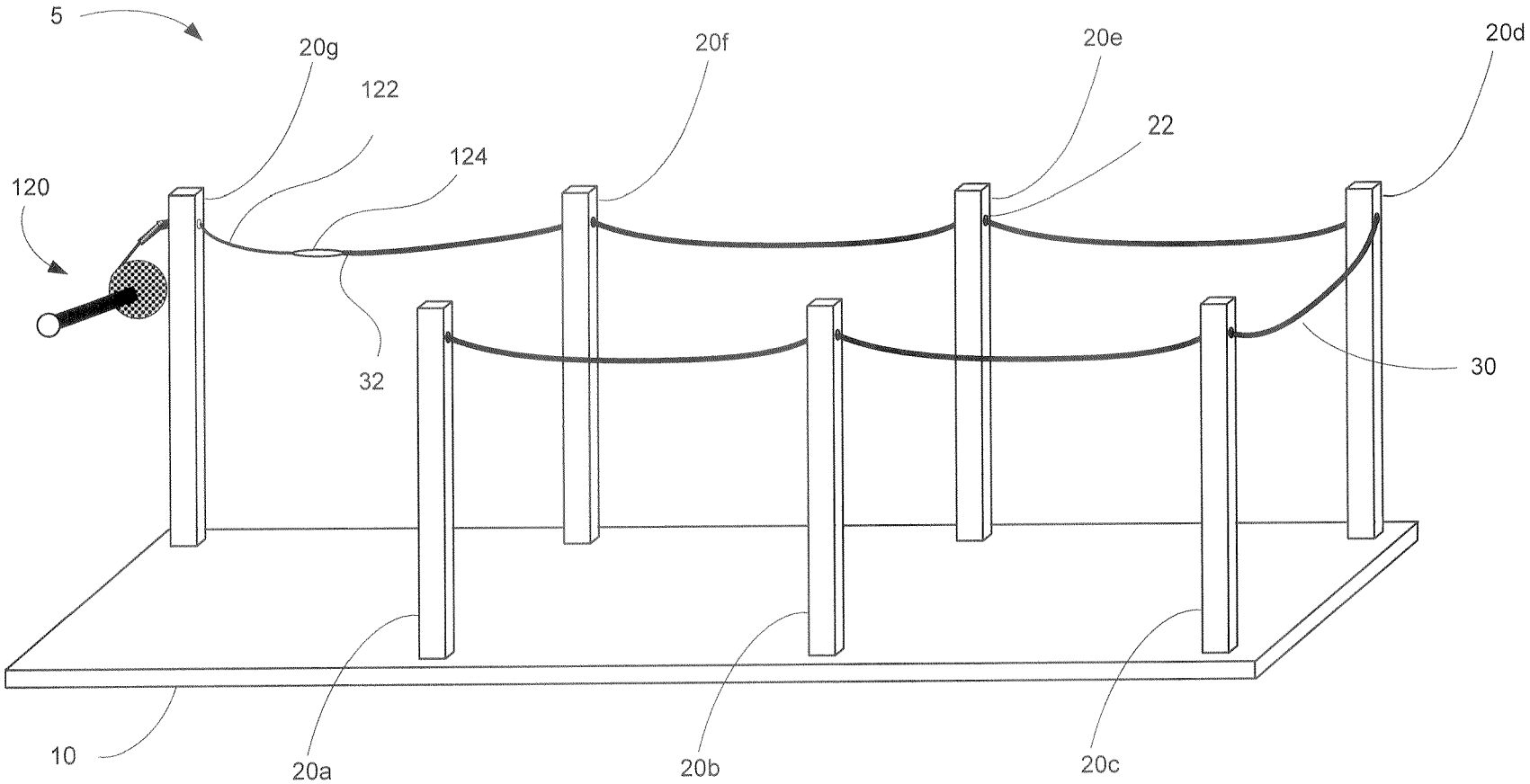
FIG. 1 is a schematic representation of a safety strand arrangement wherein the safety strand is in a slack condition.

Once the strand 30 has been strung through the stanchions 20, the safety strand 30 is in a relatively slack condition as is shown schematically in FIG. 1. In order to tighten the safety strand 30, a tensile force is applied to the free end 32 of the safety strand 30. This tensile force may be applied by manually pulling the free end 32 of the safety strand 30. In most cases, however, it is desirable to establish a greater tension in the safety strand 30 than can be obtained manually. In such cases, a mechanical tensioning mechanism 120 may be used. The tensioning mechanism 120 may be or include any device or system that can be used to apply tension to the safety strand 30. The tensioning mechanism 120 may be attached to the final stanchion in a series of stanchions as exemplified by stanchion 20*g* in FIG. 1, or may be attached to any fixed structure. As shown in FIG. 1, the tensioning mechanism 120 may include a winch 120 and a winch cable 122. The winch cable 122 may be attached to the free end 32 of the safety strand 30 by a shackle or other attachment mechanism 124. The winch itself may be a manual crank type mechanism or may be powered such as by an electric motor.

Figure 2:
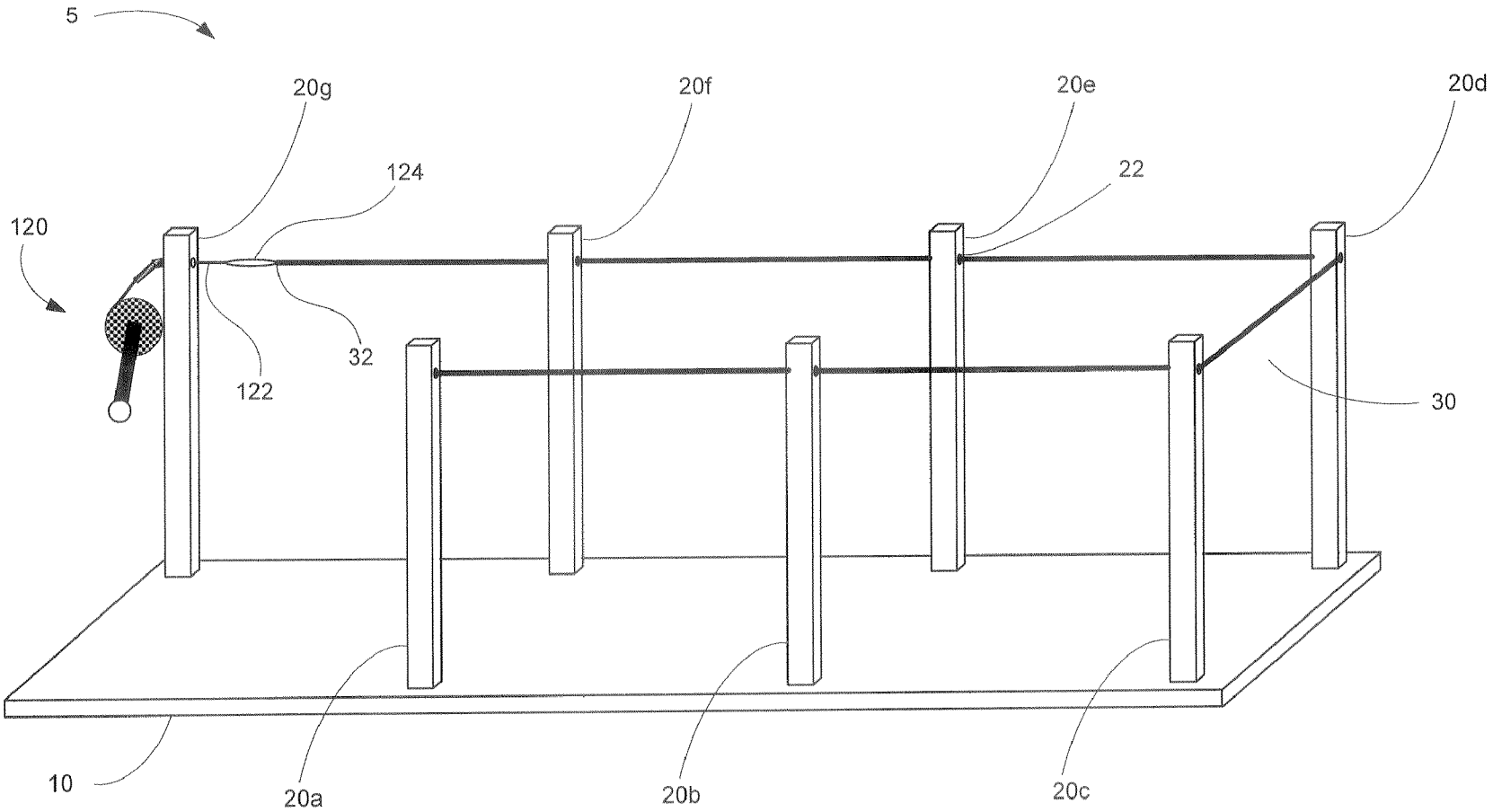
FIG. 2 is a schematic representation of the safety strand arrangement of FIG. 1 wherein the safety strand is in a tightened condition.

With the tensioning mechanism 120 attached to the safety strand 30, a tensile force is applied as shown in FIG. 2. The tensile force should not be so great as to snap or substantially bend the posts. A typical tensile force that may be used will be in a range of about 10 foot-pounds to about 100 foot-pounds of force. This tensile force causes the strand 30 to slide through the stanchion passages 22, which removes the slack from the strand 30. This causes the strand to be taut along its entire length. It can be seen, however, that releasing the tension will cause the safety strand 30 to return to its slack state. In order to maintain the taut condition, one or more safety strand locking assemblies 110 is attached to the safety strand 30 at selected stanchions 20. Each locking assembly 110 includes a mechanism for clamping the safety strand 30 to the associated stanchion 20, thereby preventing the safety strand from sliding through the passage 22.

In a preferred method according to the invention, the locking assemblies 110 are applied sequentially beginning with the selected stanchion 20 nearest in line to the fixed end of the safety strand 30. The sequence continues with the next nearest selected stanchion 20 and so on until the nearest stanchion to the tensioning mechanism 120 (or the stanchion 20 to which the tensioning mechanism 120 is attached) is reached. FIG. 3 illustrates the stage of the method where a locking mechanism 110 has been applied to each of the selected stanchions 20*b*, 20*e*, and 20*f*. It will be understood that a locking mechanism 110 need not be applied to all the stanchions 20. In this particular case, no locking mechanism 110 was applied to the two stanchions 20*c*, 20*d* at the end of the platform 10. The actual number of locking mechanisms 10 used depend upon many factors, such as the diameter of the strand 30 and the distance between stanchions 20.

With the locking mechanisms 110 in place, the tensile force on the free end 32 of the safety strand 30 may be released. As shown in FIG. 4, the safety strand 30 remains taut from the final lock-down stanchion 20*f* to the stanchion 20*a* to which the fixed end of the strand 30 is attached. It can be seen that by locking down the safety strand 30 at multiple points along the strand 30, the majority of the strand 30 will remain taut even if one of the stanchions 20 were to be bent or broken off or if the strand itself were to break at some point.

The components of certain embodiments of the invention will now be described in more detail beginning with the locking mechanisms used to secure the strand to typical stanchion configurations. The tensioning system of the invention is designed for flexibility so that it may be easily adapted to existing safety strands and/or stanchions without major modification. Toward that end, the locking mechanisms use a clamping arrangement that can be used on a variety of stanchion configurations, including the square and L-shaped stanchions shown in FIGS. 5 and 6.

Figure 7:
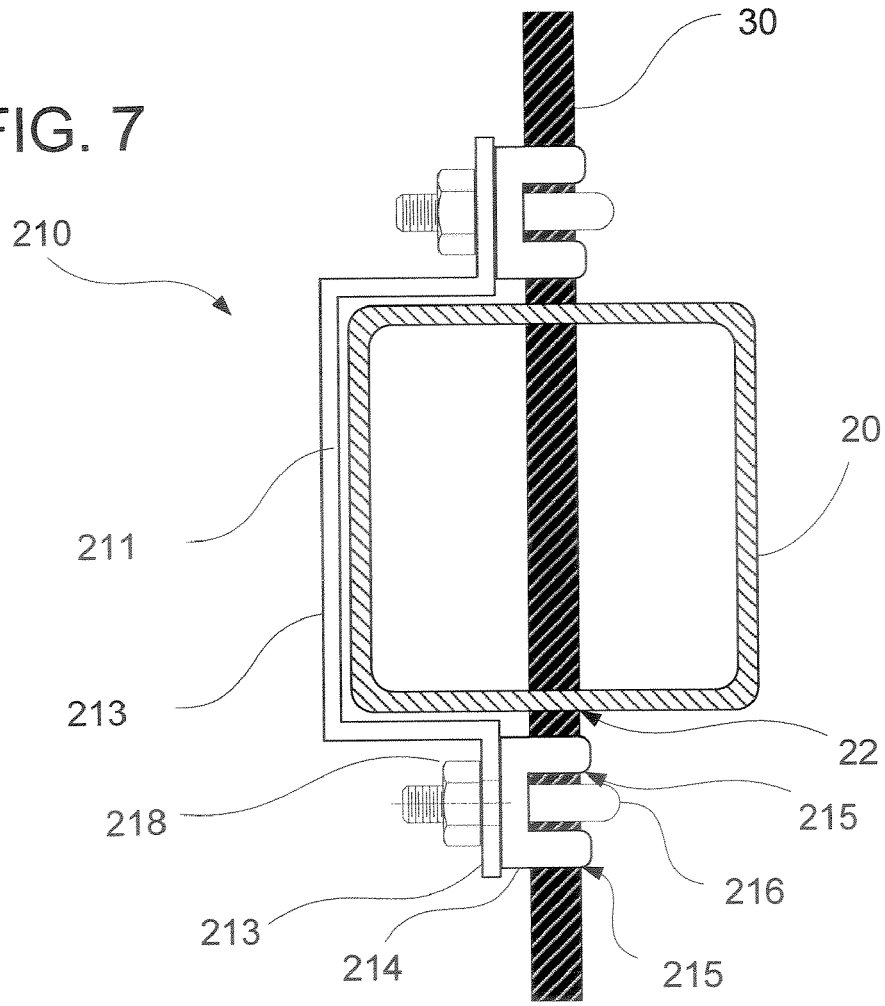
FIG. 7 is a cross-sectional view of a rectangular stanchion to which a locking arrangement according to an embodiment of the invention has been attached.
Figure 8:
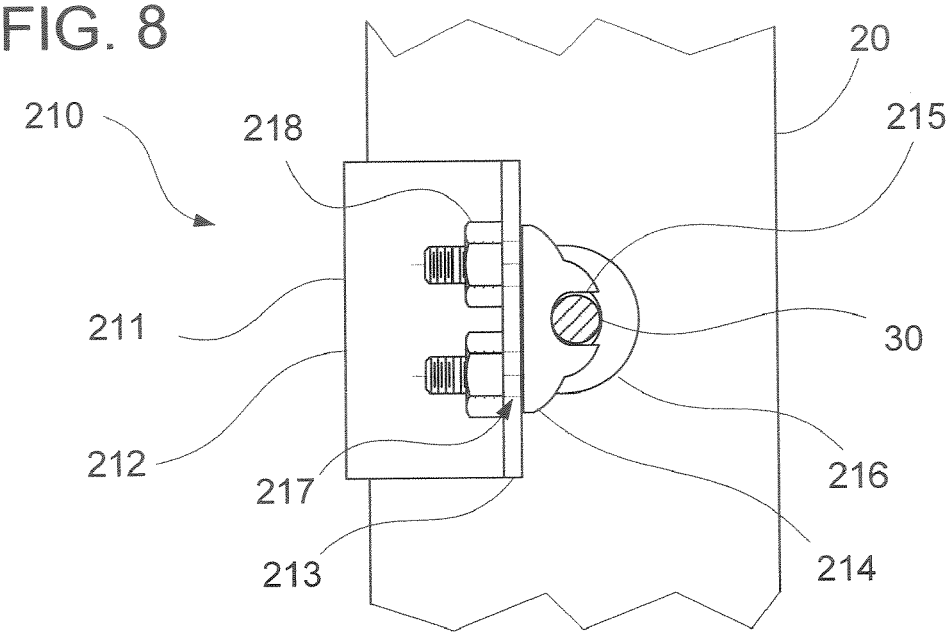
FIG. 8 is a side view of the stanchion and locking arrangement of FIG. 7.

FIGS. 7 and 8 and are top and side views of a locking mechanism 210 that is configured for locking a safety strand 30 to a rectangular stanchion 20. The rectangular stanchion 20 may be a monolithic block or may be an annular structure as shown in the section view of FIG. 7. In either case, the stanchion 20 has a passage 22 sized for slidable passage of the safety strand 30 therethrough. The locking mechanism 210 includes a bracket sized and configured to fit around one side of the rectangular stanchion 20. The bracket 212 has a U-shaped central portion 211 and a flange 213 extending outward from each leg of the central portion 211. A pair of mounting holes 217 are formed through each flange 213. The mounting holes 217 are sized and positioned to receive a U-bolt 216 that is, in turn, sized to fit around the safety strand 30. The locking mechanism 210 also includes a pair of cradles 214 that has a flat base and a pair of U-shaped cable receiving portions 215 sized to receive the safety strand 30. The cradles 214 may be attached to the bracket flanges 213 in any suitable fashion such as by bonding or welding. The cradle 214 may also be integrally formed with the bracket 212.

As shown in FIGS. 7 and 8, the cradles 214 are configured and positioned so that when the bracket 212 is properly fitted to the stanchion 20 adjacent the passage 22, the cable receiving portions 215 are in registry with the passage 22. If a safety strand 30 has been strung through the passage 22, placement of the bracket 212 in this position causes the safety strand 30 to be received into the cable receiving portions 215 of the cradles 214. Once in this position, the legs of the U-bolts 216 may be inserted into the mounting holes 217 so that the U-bolt 216 engages and traps the strand 30 against the cradles 214. Locking nuts 218 are then used to tighten the U-bolts 216 in place, thereby locking the safety strand to the bracket 212 and, thus, the stanchion 20.

It will be understood that the bracket 212 need not itself be attached to the stanchion 20. The action of clamping the strand 30 to the bracket serves to hold the bracket 212 in place. In some embodiments, however, the bracket 212 may be permanently or removably attached to the stanchion 20 in any suitable manner such as by welding or bonding or through the use of threaded fasteners.

It will also be understood that the bracket 212 and other locking mechanism hardware may be sized to fit any stanchion. By way of example, the locking mechanism 210 may be sized for a typical stanchion having a nominal 2 inch square cross-section with rounded corners and a hollow interior. The mechanism may also be sized to receive and lock a typical steel safety cable having a diameter in a range of 0.25 inch to 0.5 inch.

In variations of the embodiment illustrated in FIGS. 7 and 8, the configuration of the bracket 212 may be adjusted so that it may be fitted to stanchions with other cross sections. For example, the central portion 211 of the bracket 212 may be formed in a semicircle so that the bracket 212 may be fitted to a circular stanchion. The bracket 212 may take on any shape that allows the cable cradles 214 attached to the flanges 213 to be positioned in registration with the cable passage 22 through the stanchion.

Figure 9:
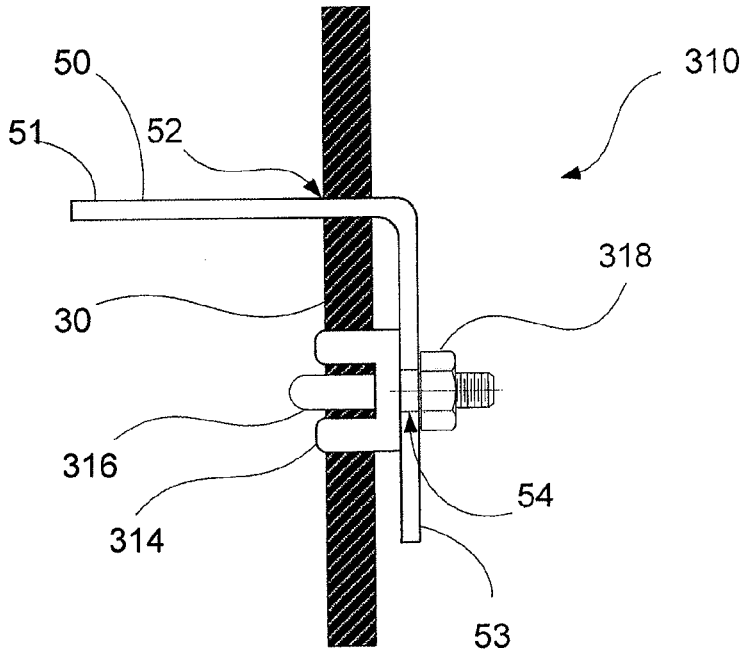
FIG. 9 is a top view of an L-shaped stanchion to which a locking arrangement according to an embodiment of the invention has been attached.
Figure 10:
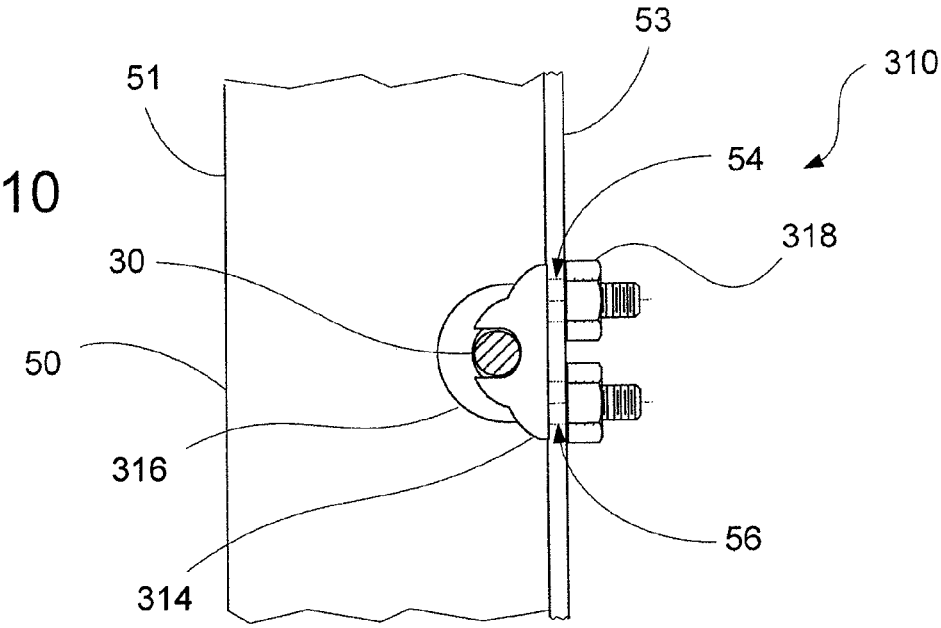
FIG. 10 is a side view of the stanchion and locking arrangement of FIG. 9.

FIGS. 9 and 10 illustrate a locking mechanism 310 that can be used to clamp a safety strand 30 to an L-shaped stanchion 50. As shown in FIG. 6, the L-shaped stanchion 50 has a cable passage hole 52 through one leg 51 of the stanchion. The locking mechanism 310 includes a single cable cradle 314 and a single U-bolt, both similar to the corresponding components of the previous embodiment. Because the stanchion 50 does not have a closed circumference, however, the locking mechanism 310 does not require a mounting bracket. Instead, a pair of mounting holes 54, 56 are formed through the second leg 53 of the stanchion. These holes are positioned near the cable passage 52 so that the cable cradle 314 can be positioned to receive a safety strand 30 passed through the cable passage 52 and so that both the safety strand 30 and the cable cradle 314 are trapped against the second leg 53 of the stanchion 50. By tightening the locking nuts 318, the U-bolt 316 serves to tightly lock the safety strand 30 to the stanchion 50, thereby preventing the safety strand 30 from moving through the passage 52.

It will be understood that the cable cradle 314 need not be attached directly to the stanchion 50. In some embodiments, however, the cable cradle 314 may be attached to the stanchion 50 using any suitable bonding or welding process. In some embodiments, the cable cradle 314 may be tacked to the stanchion 50 using a temporary adhesive to assist in installing the locking mechanism 310.

While the above embodiments describe a particular form of clamping mechanism, other suitable clamping mechanisms and fasteners may be used to carry out the methods of the invention.

Figure 11:
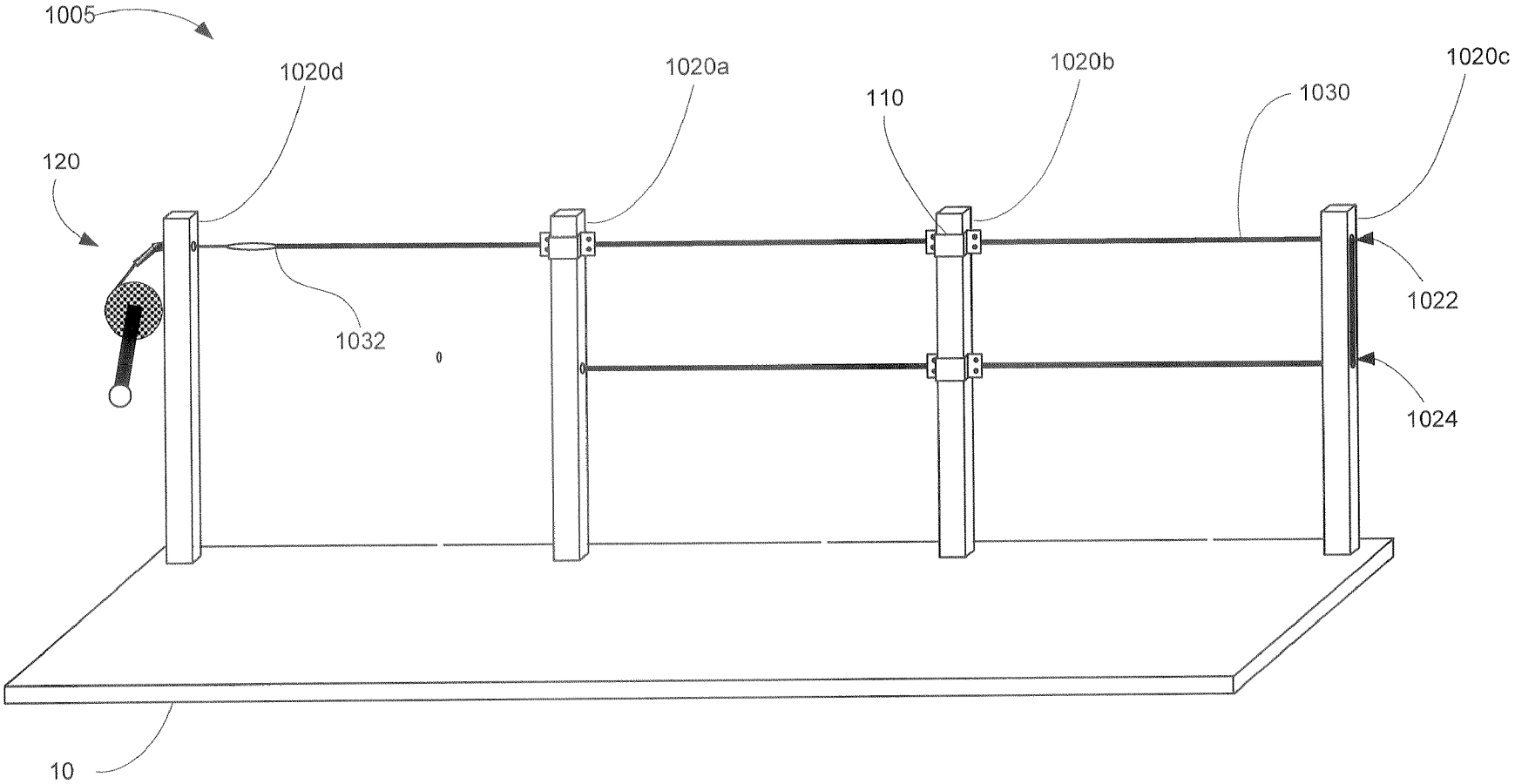
FIG. 11 is a schematic representation of a safety strand arrangement wherein the safety strand is in a tightened and locked condition.

As previously discussed, the methods of the present invention may be applied to any sequence of stanchions having a hole for passage through and support of a safety strand. The methods may also be applied to stanchions that have more than one passage so that the safety strand is passed through the stanchion more than once. FIG. 11 illustrates a safety strand arrangement 1005 having a safety strand 1030 and a plurality of stanchions 1020, each of which has an upper passage 1022 and a lower passage 1024. In a variation on the previously described locking sequence, a first end of the safety strand 1030 is fixed at a first stanchion **1020*a* at or near the lower passage 1024 of the stanchion 1020*a*. The strand 1030 is then passed through the lower passages 1024 of second and third stanchions 1020*b*, 1020*c*, upward along the outside of the third stanchion 1020*c*, and back through the upper passage 1022 of each of the third, second and first stanchions 1020*c*, 1020*b*, 1020*c*. A tensile force may then be applied to the free end 1032 of the safety strand 1030 to draw the safety strand 1030 tight. As shown in FIG. 11, this may be accomplished by attaching the free end 1032 of the strand 1030 to a tensioning mechanism 120 such as a winch. Alternatively, the tensile force may be applied manually. Once the tensile force has been applied, the safety strand 1030 may be locked to selected stanchions at one or both of the stanchion passages 1022, 1024 using the locking mechanisms 110 previously described. In a preferred approach, this will be done in sequence along the safety strand 1030, beginning with the location nearest the fixed end of the strand 1030. Upon completion of the sequence, the safety strand 1030** may be locked to the selected stanchions at two levels to provide additional protection to personnel and equipment.

It will be understood that stanchions 1020 having upper and lower passages 1022, 1024 may also be used to support two separate safety strands 1030. If such is the case, the earlier methodology may be applied to each separate strand 1030.

It will be understood that the methods and systems of the invention are not confined to horizontally disposed platforms and/or vertically positioned stanchions. The stanchions may and safety strand locked to the stanchions may be positioned at any angle. It will also be understood that the stanchions need not be parallel to one another.

While the foregoing description includes details and specificities, it is to be understood that these have been included for purposes of explanation only, and are not to be interpreted as limitations of the present invention. Modifications to the embodiments described above can be made without departing from the spirit and scope of the invention, which is intended to be encompassed by the following claims and their legal equivalents.

What is claimed is:

1. A system comprising:

a safety strand;

a plurality of sequentially arranged stanchions each having a passage bore therethrough;

tensioning means for applying a tensile force to a first end of the safety strand when the safety strand is disposed through the passage bore defined in each of the sequentially arranged stanchions and a second end of the safety strand is secured to an immovable object; and a plurality of locking mechanisms, each locking mechanism comprising a cable cradle having a receiving channel receiving a portion of the safety strand, a clamping arrangement engaging and trapping the portion of the safety strand within the receiving channel, and means for securing the cable cradle and clamping arrangement to a selected one of the plurality of stanchions when the safety strand is disposed through the passage bore of the selected stanchion, the cable cradle and means for securing being configured so that when the cable cradle is secured to the selected stanchion, the receiving channel is arranged adjacent an outer surface of the stanchion and is in registry with the passage bore wherein after the tensile force is applied to the first end of the safety strand and the locking mechanisms have engaged and trapped the safety strand, the safety strand resists sliding through the passage bore and the safety strand remains taut from the second end to the selected stanchion.

2. A system according to claim 1 wherein the means for securing the cable cradle and clamping arrangement comprises a bracket having a central portion configured for engagement with the selected stanchion and a pair of flanges, at least one of said flanges being configured for attachment of the cable cradle and clamping arrangement thereto.

3. A system according to claim 2 wherein the at least one flange has a pair of flange holes formed therethrough and the clamping arrangement includes a U-bolt fastener sized and configured so that the legs of the U-bolt may be installed around the safety strand and through the flange holes, the holes being positioned so that when the U-bolt is so-installed, it traps the safety strand within the receiving channel.

4. A system according to claim 1 wherein the means for securing the cable cradle and clamping arrangement is configured to engage a stanchion having a rectangular cross-section.

5. A system according to claim 4 wherein the means for securing the cable cradle and clamping arrangement comprises a bracket having a U-shaped central portion formed by a base and two legs sized to surround and engage three sides of the rectangular stanchion, and a pair of flanges, one flange extending outwardly from each leg, each flange having a pair of flange holes formed therethrough, the flange holes being sized and positioned to receive a U-bolt fastener configured to surround the safety strand circumference when the safety strand is threaded through the passage bore of the rectangular stanchion, and wherein the clamping arrangement comprises a pair of U-bolt fasteners, each U-bolt fastener having a pair of threaded legs sized and configured for insertion through the flange holes and being sized and configured so that the legs of the U-bolt may be installed around the safety strand and through the flange holes, the holes being positioned so that when the U-bolt is so-installed, it traps the safety strand within the receiving channel.

6. A system according to claim 1 wherein the means for securing the cable cradle and clamping arrangement is configured to engage a stanchion having an L-shaped cross-section, wherein the passage bore is formed through a first leg of the L-shape and wherein the means for securing includes a pair of flange holes formed through a second leg of the L-shape and the clamping arrangement includes a U-bolt fastener sized and configured so that the legs of the U-bolt are installable around the safety strand and through the flange holes, the holes being positioned so that when the U-bolt is so-installed, it traps the safety strand within the receiving channel.

7. A system according to claim 1 wherein the tensioning means comprises a winch.

8. A system according to claim 7 further comprising means for removably attaching the winch to a selected one of the plurality of stanchions.

9. A system comprising:

a safety strand;

a plurality of sequentially arranged stanchions, each stanchion defining a passage bore through which the safety strand passes;

a bracket having at least one flange extending therefrom, the at least one flange having a pair of flange holes formed therethrough on which a locking mechanism is mounted;

the locking mechanism comprising:

a cable cradle disposed on the at least one flange and defining a receiving channel receiving a portion of the safety strand; and a U-bolt fastener having a pair of threaded legs installed around the safety strand and through the flange holes to secure the safety strand within the receiving channel, wherein the U-bolt fastener locks the safety strand to the cable cradle and secures the cable cradle to the flange such that the bracket is held in place against at least one stanchion and the safety strand resists sliding through the passage bore, the cable cradle is arranged adjacent an outer surface of the stanchion, and the receiving channel is substantially aligned with the passage bore defined in the stanchion when the safety strand is received through the passage bore of the stanchion and is locked in the receiving channel.

10. A system according to claim 9, wherein the bracket comprises a U-shaped central portion formed by a base and two legs configured to surround and engage three sides of a rectangular stanchion, and wherein one flange extends from each leg of the bracket.

11. A system according to claim 9, wherein the bracket is configured to engage a stanchion having a circular cross-section, wherein two flanges extend from the bracket such that, when the bracket engages the stanchion, the flanges are disposed generally opposite one another with respect to the stanchion.

12. A system according to claim 9 further comprising tensioning means for applying a tensile force to a first end of the safety strand when the safety strand is disposed through the passage bore defined in each of the sequentially arranged stanchions and a second end of the safety strand is secured to an immovable object.

13. A system according to claim 12, wherein the tensioning means comprises a winch.

* * * * *